US006393309B1

(12) United States Patent
Mansour

(10) Patent No.: US 6,393,309 B1
(45) Date of Patent: May 21, 2002

(54) MICROWAVE SWITCH AND METHOD OF OPERATION THEREOF

(75) Inventor: Raafat R. Mansour, Waterloo (CA)

(73) Assignee: Com Dev Ltd., Cambridge (CA)

( * ) Notice: Subject to any disclaimer, the term of this patent is extended or adjusted under 35 U.S.C. 154(b) by 0 days.

(21) Appl. No.: 09/190,161

(22) Filed: Nov. 12, 1998

Related U.S. Application Data

(60) Provisional application No. 60/065,351, filed on Nov. 12, 1997.

(51) Int. Cl.[7] ..... H01P 1/10; H01B 12/02

(52) U.S. Cl. ..... 505/210; 333/101; 333/104; 333/262; 333/99.005; 505/700; 505/703

(58) Field of Search ..... 333/101, 103, 333/104, 262, 995; 505/210, 700, 701, 703, 866

(56) References Cited

U.S. PATENT DOCUMENTS 4,876,239 A * 10/1989 Cachier ..... 505/210
5,105,200 A * 4/1992 Koepf ..... 333/101 X
5,350,739 A * 9/1994 Martens et al. ..... 333/262 X
5,773,875 A * 6/1998 Chan ..... 505/703 X
5,912,472 A * 6/1999 Voigtlaender et al. .. 333/925 X

FOREIGN PATENT DOCUMENTS

JP 22040 * 1/1989 ..... 505/703
JP 54740 * 3/1989 ..... 505/703

* cited by examiner

*Primary Examiner*—Benny T. Lee
(74) *Attorney, Agent, or Firm*—Daryl W. Schnurr

(57) ABSTRACT

An HTS microwave circuit has two layers formed with metallic film on a substrate. One layer has a first circuit and another layer has a second circuit, the two circuits being coupled to one another. The second circuit has elements that are incompatible with HTS material such as MEMS technology and flip-chip technology. A microwave switch has a first layer that can carry an RF signal and a second layer that has switch elements that are controlled by a DC. signal. The RF signal and DC signal are isolated from one another. The switch elements include various technologies including a narrow HTS strip. A single layer HTS microwave switch can also be utilized where the switch element is a narrow HTS line. A method of combing HTS technology with incompatible technologies into one device is provided.

29 Claims, 10 Drawing Sheets

MICROWAVE SWITCH AND METHOD OF OPERATION THEREOF

This application claim benefit to Provisional Application No. 60/065,351 Nov. 12, 1997.

BACKGROUND OF THE INVENTION

1. Field of Invention

The present invention relates to microwave switches and, more particularly, to the realization of high temperature superconductive switches and circuits.

2. Description of the Prior Art

The majority of communication systems utilize RF switches to achieve dynamic interconnectivity or to improve system reliability by switching to back-up equipment in case of a failure. The two types of switches that are currently being used are electromechanical switches and solid state switches. Electromechanical switches are usually used in applications where switching time can be slow while low insertion loss and high isolation are required. the problem, however, with mechanical switches is that they are bulky. Solid state switches, on the other hand, are used-in applications where switching time must be fast. Although, solid state switches are relatively small in size and mass, their insertion loss performance and power consumption are prohibitively high in many, applications.

When working with High Temperature Superconductive (HTS) circuits difficulties have been encountered in attempting to combine incompatible components with HTS into the HTS circuit. It is known that extremely high temperatures are required during the fabricated of MEMS devices and that extremely high temperatures can be harmful to HTS circuits. Further, it is known that a flip chip can be made out of gold and that gold and HTS are not compatible. For example, flip-chip technology and micro-electromechanical systems (MEMS) is incompatible with HTS circuits.

SUMMARY OF THE INVENTION

High Temperature Superconductive (HTS) switches can be used to replace both electromechanical switches and solid state switches in both low and high speed applications. The advantages are low insertion loss, small size, light weight and low power consumption.

It is an object of the present invention to provide a novel configuration for a single layer or multi-layer HTS switch. It is a further object of the present invention to provide HTS switches by integrating switching elements with an HTS planar circuit.

An HTS microwave circuit has a first layer and a second layer, the first layer having a first HTS microwave circuit extending between an input and an output. The second layer has a second microwave circuit that is coupled to the first circuit. The second circuit has at least one element that is compatible with at least one of MEMS technology and flip-chip technology, but incompatible with HTS material, the at least one element being connected into the second circuit interact with and control the HTS circuit.

A microwave switch has a first layer and a second layer. The first layer has a first microwave circuit that can carry an RF signal between an input and an output. The second layer has a second microwave circuit that is coupled to the first circuit. The second circuit has at least one switch element that can be controlled between an off position and an on position by a DC signal, the RF signal and the DC signal being isolated from one another.

A microwave switch has an HTS microwave circuit extending between an input and an output. The circuit has a transmission line containing a narrow length of high temperature superconductive material connecting the HTS circuit to ground. The switch has a DC power source connected to the narrow length of high temperature superconductive material. The DC power source is connected to change the narrow length of high temperature superconductive material between superconductive and non-superconductive. There are means to prevent current from the DC power source from flowing into the circuit beyond the narrow length of high temperature superconductive material.

A method of combining a first HTS circuit with a second circuit having at least one of flip-chip technology, MEMS technology and mechanical technology, the method comprising constructing the first circuit on a first substrate having a ground plane, constructing the second circuit on a second substrate, arranging said substrates to capacitatively or inductively couple the second circuit to the first circuit and controlling the first circuit through the second circuit.

DESCRIPTION OF A PREFERRED EMBODIMENT

Figure 1:
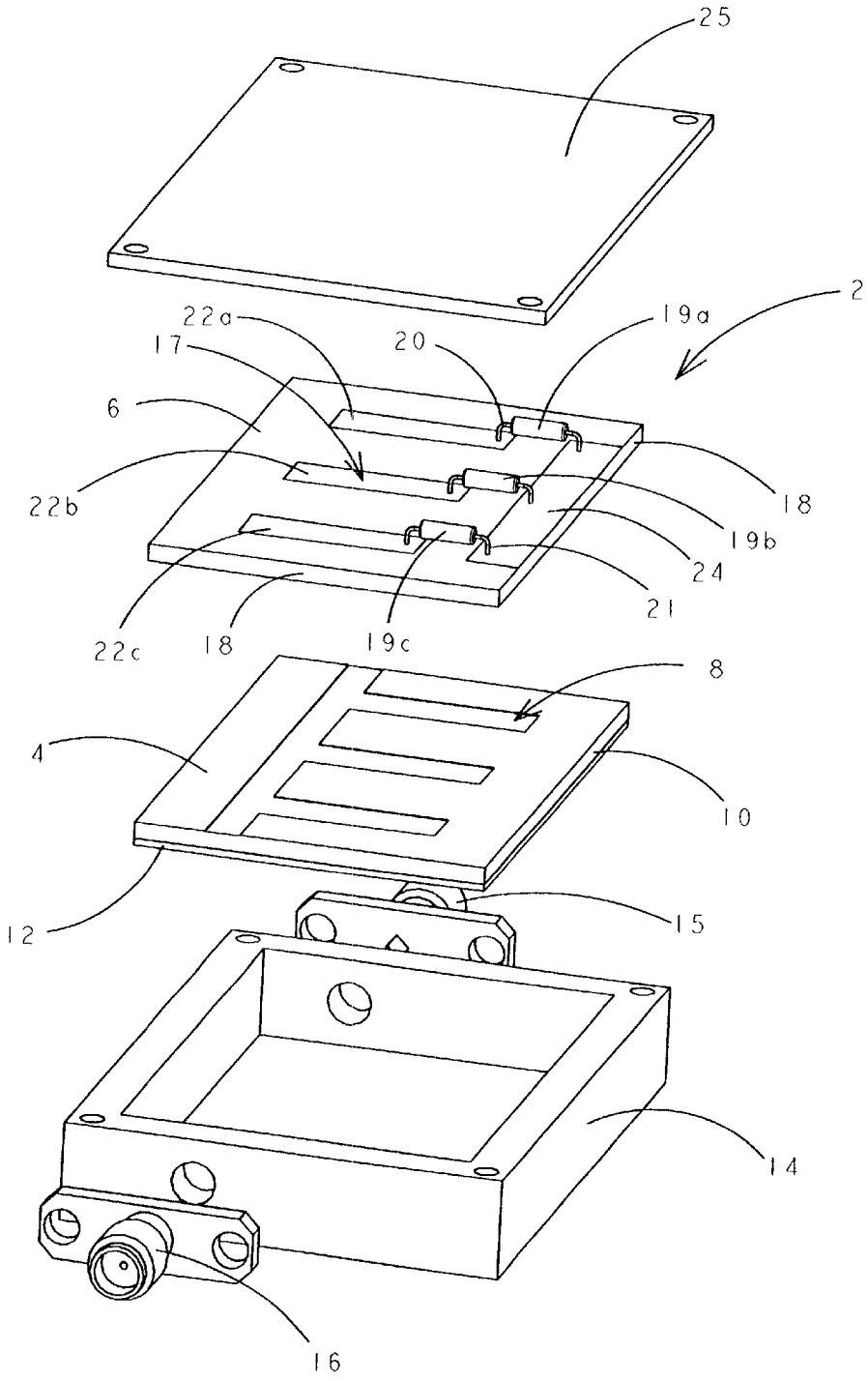
FIG. 1 is an exploded perspective view of a two layer HTS switch.

In FIG. 1, there is shown a switch 2 according to the preferred embodiment of the present invention,. The switch 2 consists of two layers 4 and 6. The layer 4 consists of an HTS circuit 8 printed on a substrate 10 attached to a ground plane 12. The HTS circuit 8 is assembled in a housing 14 by epoxying the ground plane 12 to the bottom of the housing 14. The input/output 15 and 16 are attached to the HTS circuit 8. Layer 6 consists of a circuit 17 printed on a substrate 18. Preferably, there is no ground plane immediately beneath the substrate 18. If desired, a ground plane could be located beneath the substrate 18 with openings where required for coupling purposes. The layer 6 is placed on the top of the layer 4 by using low loss adhesive or any other means. The layer 6 can be spaced apart from the layer 4 by supports (not shown) leaving an air space between the two layers. The circuit is assembled with three on/off switch elements 19*a*, 19*b* and 19*c*. Each switch element has two terminals 20, 21. One terminal 20 is connected to the ends of transmission lines 22*a*, 22*b* and 22*c* and the other terminal 21 is connected to a transverse line 24 which is short-circuited to the housing 14. A plate 25 is a top cover for the switch 2. There is one switch element for each transmission line of the circuit 17.

Figure 2:
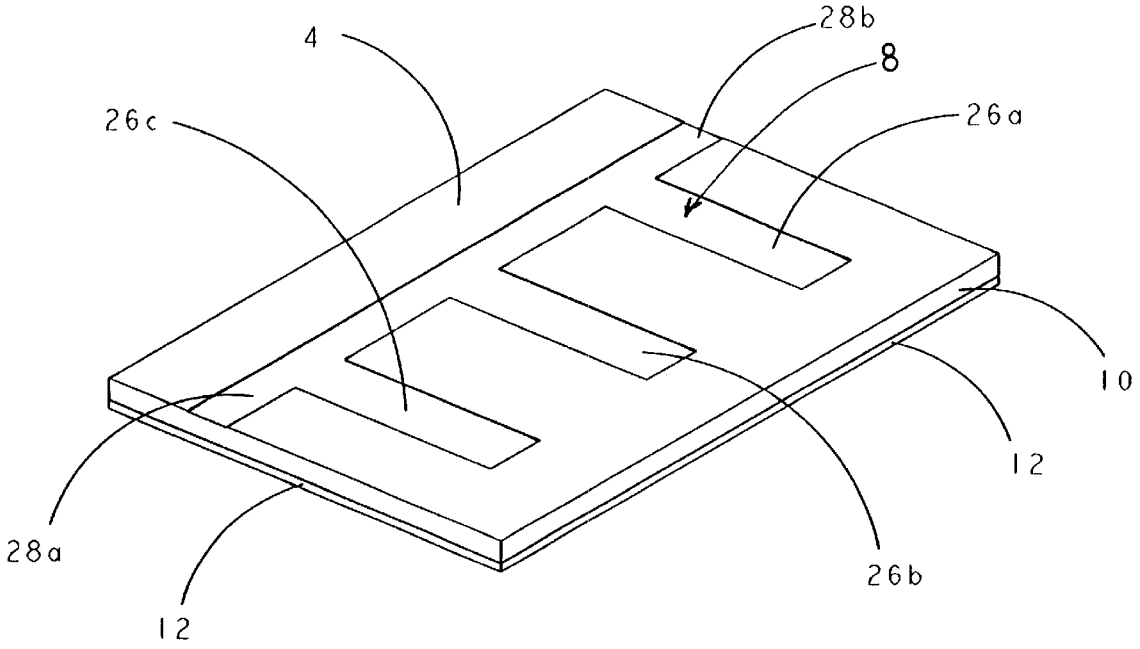
FIG. 2 is an enlarged perspective view of the first layer of the switch of FIG. 1.

FIG. 2 illustrates a detailed description of the HTS circuit 8. Each of the transmission lines 26*a*, 26*b* and 26*c* represent one port of a T-junction. The three T-junctions are connected by HTS transmission lines. The number of sections (T-junctions) determines the bandwidth of the switch. The more sections the circuit has, the wider the bandwidth the switch would exhibit. Thus, a switch can have more than three or fewer than three T-junctions. The circuit has two contact pads 28*a*, 28*b* made out of gold or any other metals to allow connections to the input and output connectors.

Figure 3:
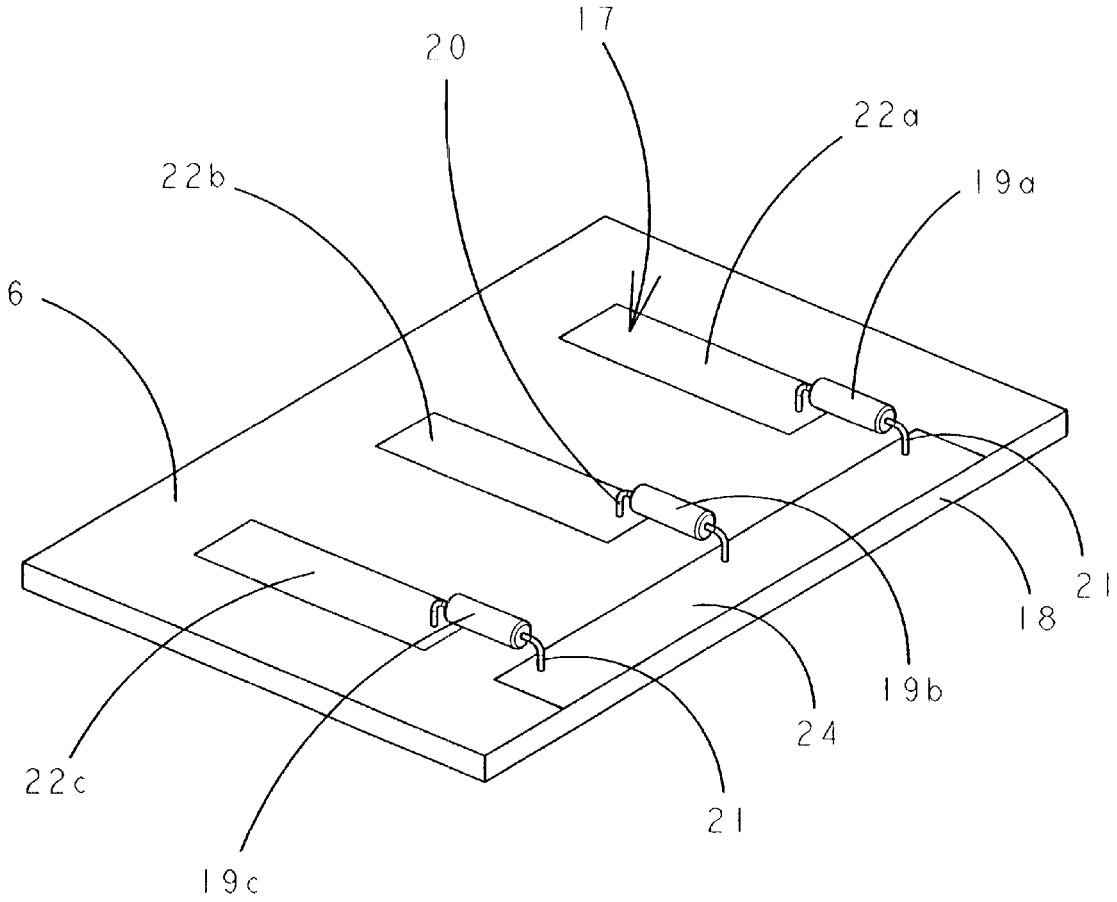
FIG. 3 is an enlarged perspective view of a second layer of the switch of FIG. 1.

FIG. 3 illustrates a detailed description of the circuit 17 printed on the layer 6. It consists of three transmission lines 22*a*, 22*b* and 22*c* mounted on the substrate such that the center of the lines 22*a*, 22*b* and 22*c* align with transmission lines 26*a*, 26*b* and 26*c* (not shown in FIG. 3) respectively shown in FIG. 2. The widths and the lengths of the lines 22*a*, 22*b* and 22*c* do not have to be necessarily the same as the widths and lengths of the lines 26*a*, 26*b* and 26*c* respectively. The lines 26*a*, 26*b* and 26*c* are coupled either capacitatively or inductively to the lines 22*a*, 22*b* and 22*c* respectively. The transmission lines 22*a*, 22*b* and 22*c* are made out of HTS, gold or any other metals. Three switch elements 19*a*, 19*b* and 19*c* are connected to the circuit 17. The switch elements can be PIN, FET or GaAs diodes. One terminal 20 of each switch element 19*a*, 19*b* and 19*c* is connected to the ends of the transmission lines 22*a*, 22*b* and 22*c* respectively. The other terminal 21 of each switch element 19*a*, 19*b* and 19*c* is connected to the transverse line 24, which is short-circuited to the housing. Mechanical type switches could be used instead of diodes to short circuit the gap between the lines 22*a*, 22*b*, 22*c* and the transverse line 24. Alternatively MEMS (Micro-Electro-Mechanical System) switches could be used for the switch elements 19*a*, 19*b* and 19*c* or mechanical switches could be used. The switch elements are synchronously turned on/off. The switch shown in FIG. 1 is in the ON state when the switch elements are in the ON state and the switch circuit is in the OFF state when the switch elements are in the OFF state. The switch could be designed to operate in an opposite manner where the switch circuit is ON when the switch elements are OFF and vice versa.

Figure 4:
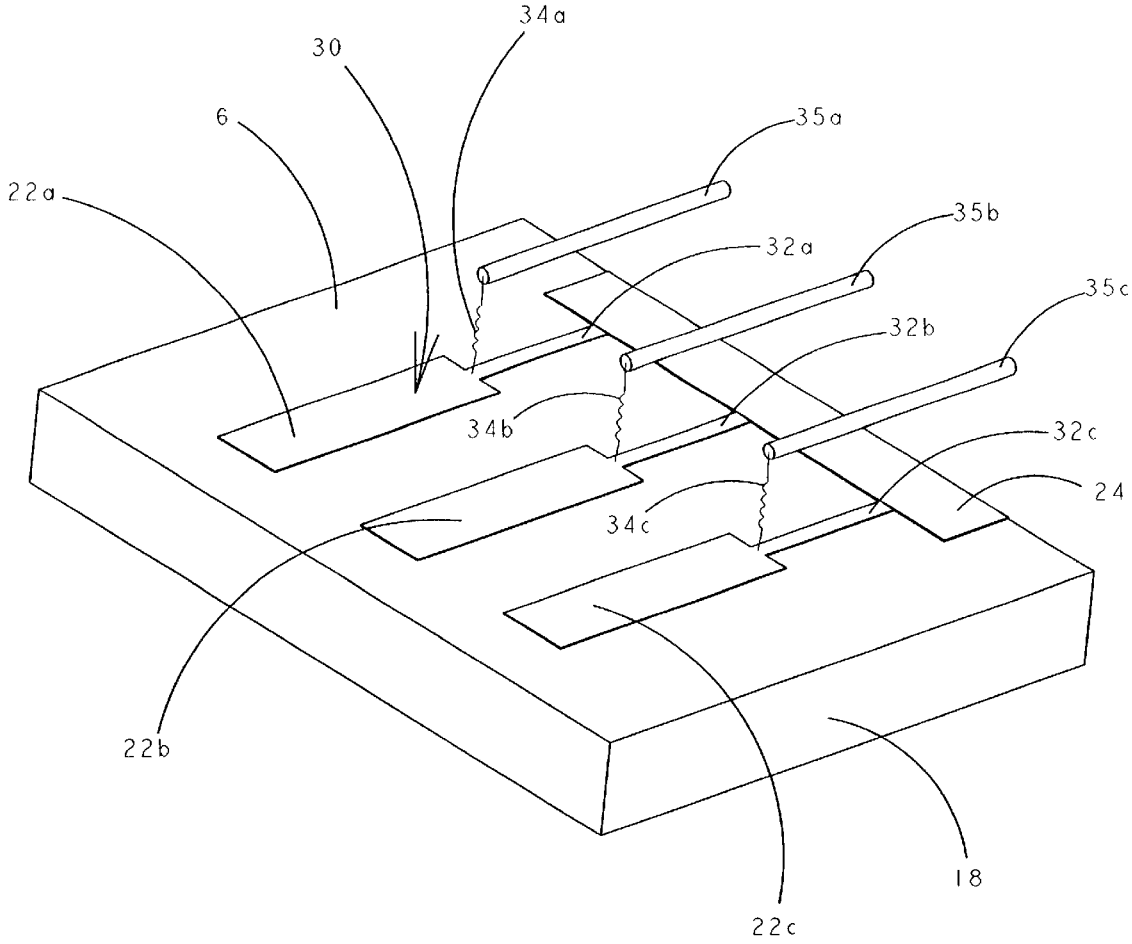
FIG. 4 is an enlarged perspective view of a further embodiment of a second layer having switching elements made from HTS materials.

In FIG. 4, there is a shown a further embodiment for a circuit 30 of the second layer 6. The same reference numerals are used for those components that are the same as the components of FIG. 3. The lines 22*a*, 22*b* and 22*c* are made out of HTS material. The switch elements are narrow transmission lines 32*a*, 32*b* and 32*c*, which are also made out of HTS material. DC current is supplied to the lines 32*a*, 32*b* and 32*c* through inductors 34*a*, 34*b* and 34*c* respectively connected to conductors 35*a*, 35*b* and 35*c* respectively. When the DC current is off, the lines 32*a*, 32*b* and 32*c* are superconductive and a short circuit exists through the transverse line 24 of the layer 6. The switch 2 is then in the ON position and the switch elements are also in the ON position. When the DC current is switched on and is high enough, the narrow transmission lines 32*a*, 32*b* and 32*c* switch from the superconductive state to the non-superconductive state. The switch elements are then in the off position and the switch 2 is in the off position. By the two layer arrangement disclosed, the RF and DC signals are isolated from one another.

Figure 5:
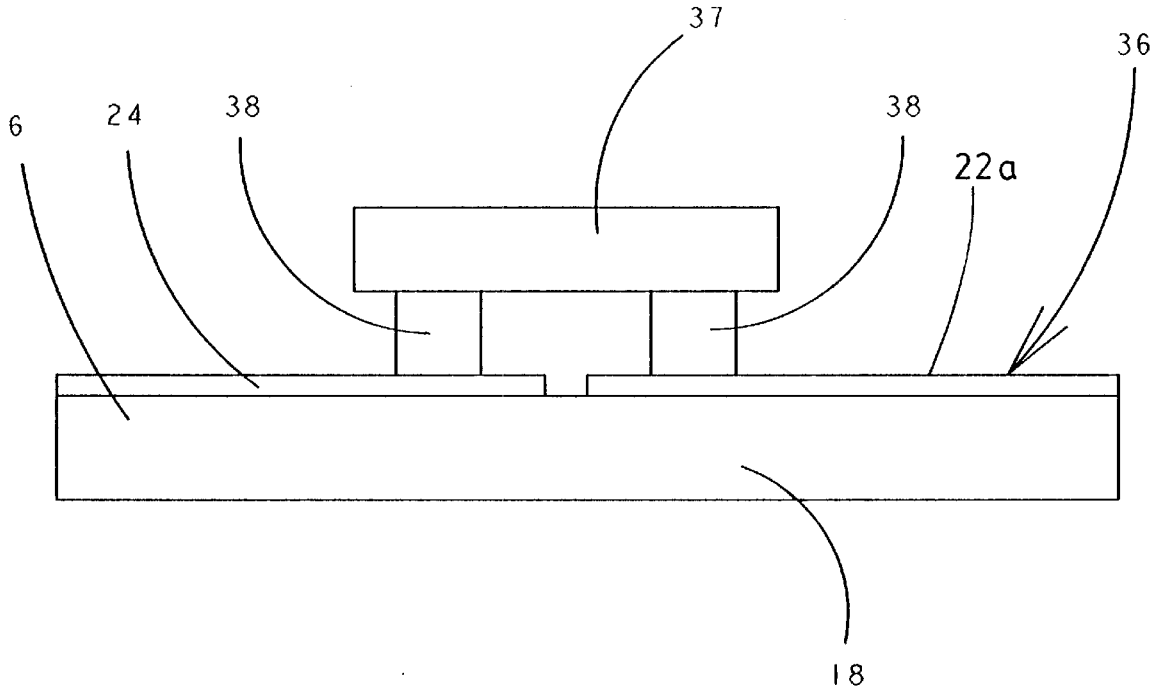
FIG. 5 is a side view of a further embodiment of a second layer having switching elements made from a flip-chip technology.

In FIG. 5, there is shown a further embodiment of a circuit 36 on the layer 6. The same reference numerals are used in FIG. 5 as those used in FIG. 3 for those components that are identical. The circuit 36 and the transverse line 24 are laid out in a manner similar to that shown in FIG. 3 for the circuit 17 and the transverse line 24 on the substrate 18 except that the two circuits 36, 24 are interconnected using flip-chip technology. The transmission lines (22*a*, 22*b* and 22*c*—of which only 22*a* is shown in FIG. 5) which make up the circuit 36 as well as the transverse line 24 are made from metal that is compatible with flip-chip technology. Substrate 18 is also made of a material that is compatible with flip-chip technology. A chip 37, supported by chip bumps 38 is connected between the transmission line 22*a* and the transverse line 24. A chip and chip bumps will also connect the transmission lines 22*b* (not shown) to the transverse line 24 and a further chip and chip bumps will connect the transmission line 22*c* (not shown) to the transverse line 24 even though only one chip 37 is shown in FIG. 5. The chip 37 can be a PIN or FET diode, which is connected to a DC power supply (not shown). The DC power supply switches the chip on and off, thereby causing the switch 2 to turn on and off respectively. The flux which is typically generated during the soldering process of the chip bumps can damage HTS material. The two layer circuit where the bottom layer 4 uses HTS material as shown in FIG. 2 while the top layer 6 employs the flip-chip technology allows the combination of flip-chip technology with HTS technology as the layer 6 can be manufactured separately from the layer 4. The diode shown in FIG. 5 is in chip form. Alternatively, the diode could be in encapsulated form (not shown) where the diode is attached between the line 22*a* and the transverse line 24 using wire bonding or other suitable means. The configuration of the layer 6 shown in FIG. 5 still permits the isolation between RF and DC signals.

Figure 6:
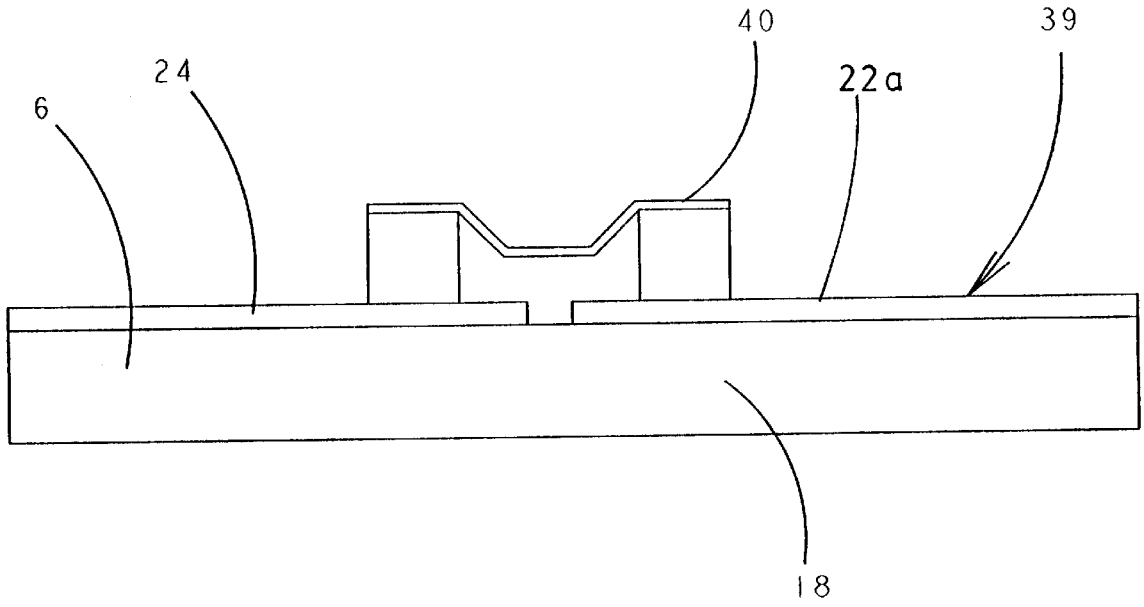
FIG. 6 is an enlarged side view of a further embodiment of a second layer having switching elements made from micro-electromechanical systems.

In FIG. 6, there is shown yet another embodiment of a circuit 39 on the layer 6. The same reference numerals are used in FIG. 6 for those components that are identical to the components of FIG. 3. As with FIG. 5, only one transmission line 22*a* is shown, but the transmission lines 22*b* and 22*c* are laid out in a manner similar to that shown in FIG. 3. As can be seen, a microelectromechanical (MEMS) system 40 connects the transmission line 22*a* of the circuit 39 with the transverse line 24. Second and third MEMS switches (not shown) would connect transmission lines 22*b* and 22*c* (also not shown) to the transverse line 24. The MEMS switches are placed on the substrate 18 to interconnect the circuits 39 with transverse line 24 using conventional MEMS technology. MEMS technology is not directly compatible with HTS technology but the layer 6 can be manufactured using conventional MEMS technology separate and apart from the layer 4, which can use HTS technology. After manufacture, the two layers can be brought together.

The three embodiments of the layers 6 shown in FIGS. 4, 5 and 6 respectively can be substituted for the embodiment shown in FIG. 3 of the layer 6 and placed into the switch 2 of FIG. 1. While the embodiment shown in FIG. 6 is the preferred embodiment, there may be circumstances requiring particular performance characteristics where one of the other embodiments will be preferred.

Figure 7:
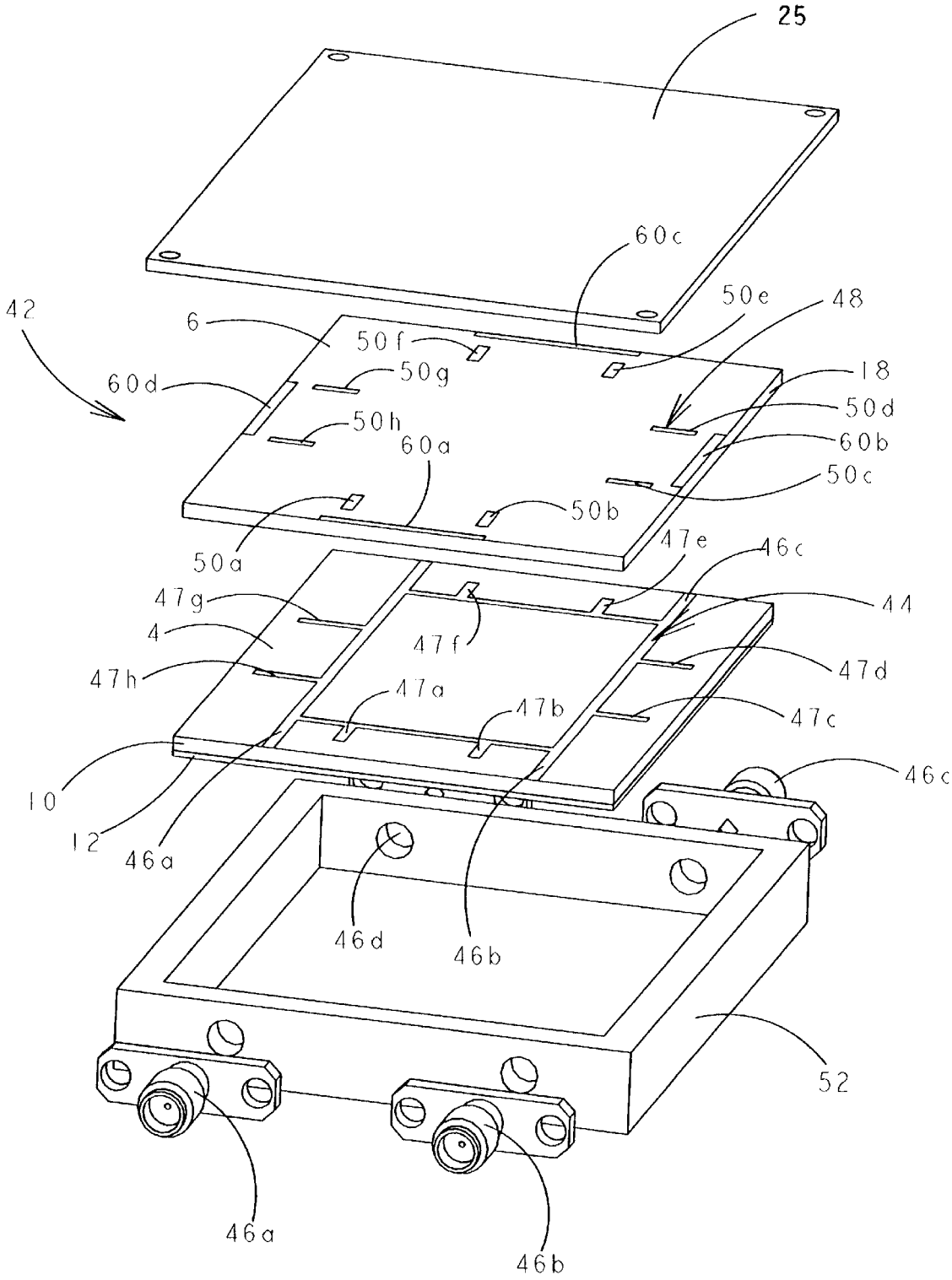
FIG. 7 is an exploded perspective view of a C-switch.

FIG. 7 shows a preferred embodiment for a C-switch 42. An HTS switch 42 consists of two layers 4 and 6. Layer 4 consists of an HTS circuit 44 having four ports 46*a*, 46*b*, 46*c* and 46*d* printed on a substrate 10 attached to a ground plane 12. The layer 6 has a circuit 48 consisting of several transmission lines 50*a*, 50*b*, 50*c*, 50*d*, 50*e*, 50*f*, 50*g*, 50*h* mounted on a substrate 18 to align with the lines 47*a*, 47*b*, 47*c*, 47*d*, 47*e*, 47*f*, 47*g*, 47*h* respectively of the layer 4. The circuit 44 is assembled in a housing by attaching the ground plane 12 to a bottom of the housing 52 using epoxy soldering or any other means. A bottom side of the layer 6 is attached to the top side of the layer 4 using adhesive or any other suitable means. The switch elements (not shown) could be of the semiconductor type or mechanical type. Each switching element has two terminals. One terminal is attached to the lines 50*a*–50*h* while the other terminal is attached to circuits 60*a*, 60*b*, 60*c* and 60*d*, which are short circuited to the housing 52. The plate 25 is used as a cover for the circuits shown.

Figure 8A:
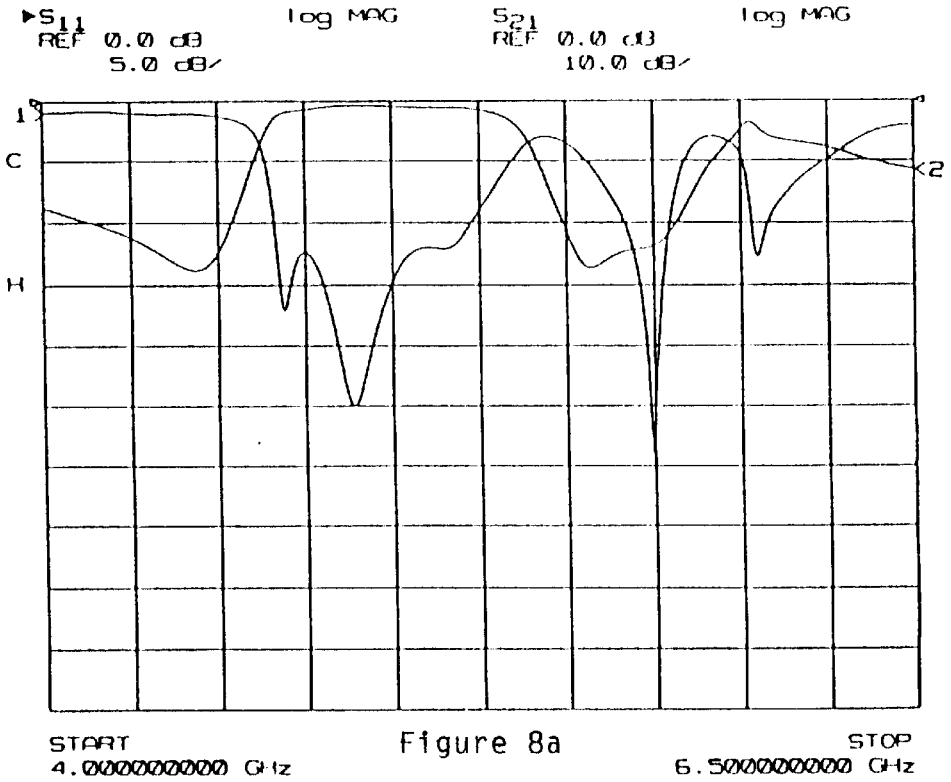
FIG. 8*a* is a graph of the measured results of a C-switch built in accordance with FIG. 7 in the on position.
Figure 8B:
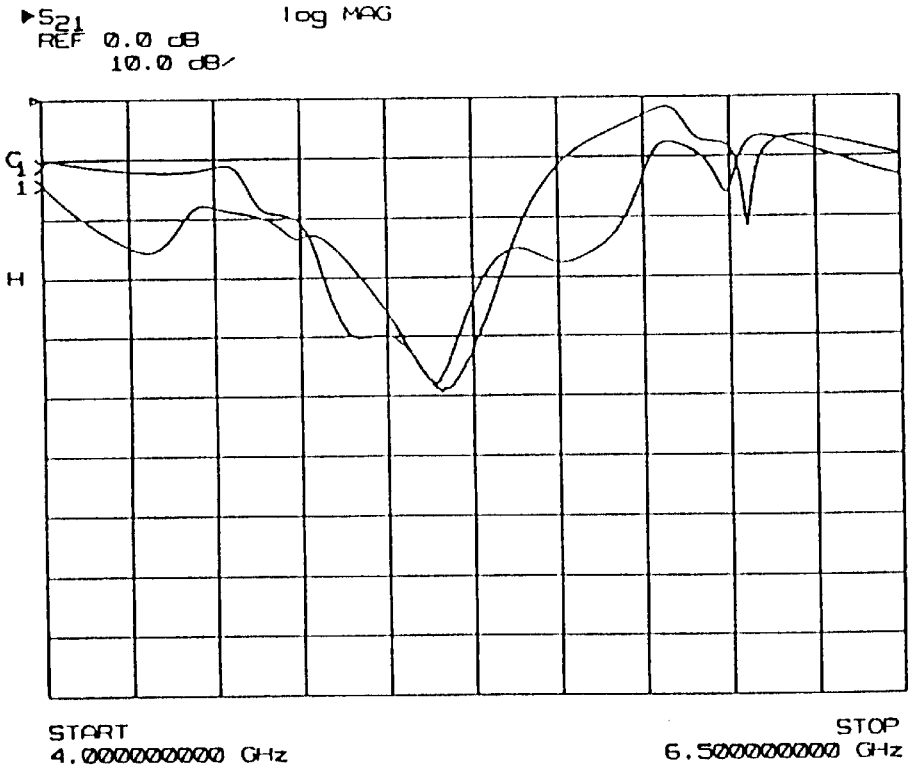
FIG. 8*b* is a graph of the measured results of a C-switch built in accordance with FIG. 7 in the off position.

FIGS. 8*a* and 8*b* show the measured results for an HTS C-switch 42 as described in FIG. 7. The graph shown in FIG. 8*a* is a graph of the isolation and return loss when the switch is on and the graph shown in FIG. 8*b* is a graph of the isolation and return loss when the switch is off. The switching elements used in the switch 42 for the measured results shown are the narrow HTS line switching elements shown in FIG. 4.

Figure 9:
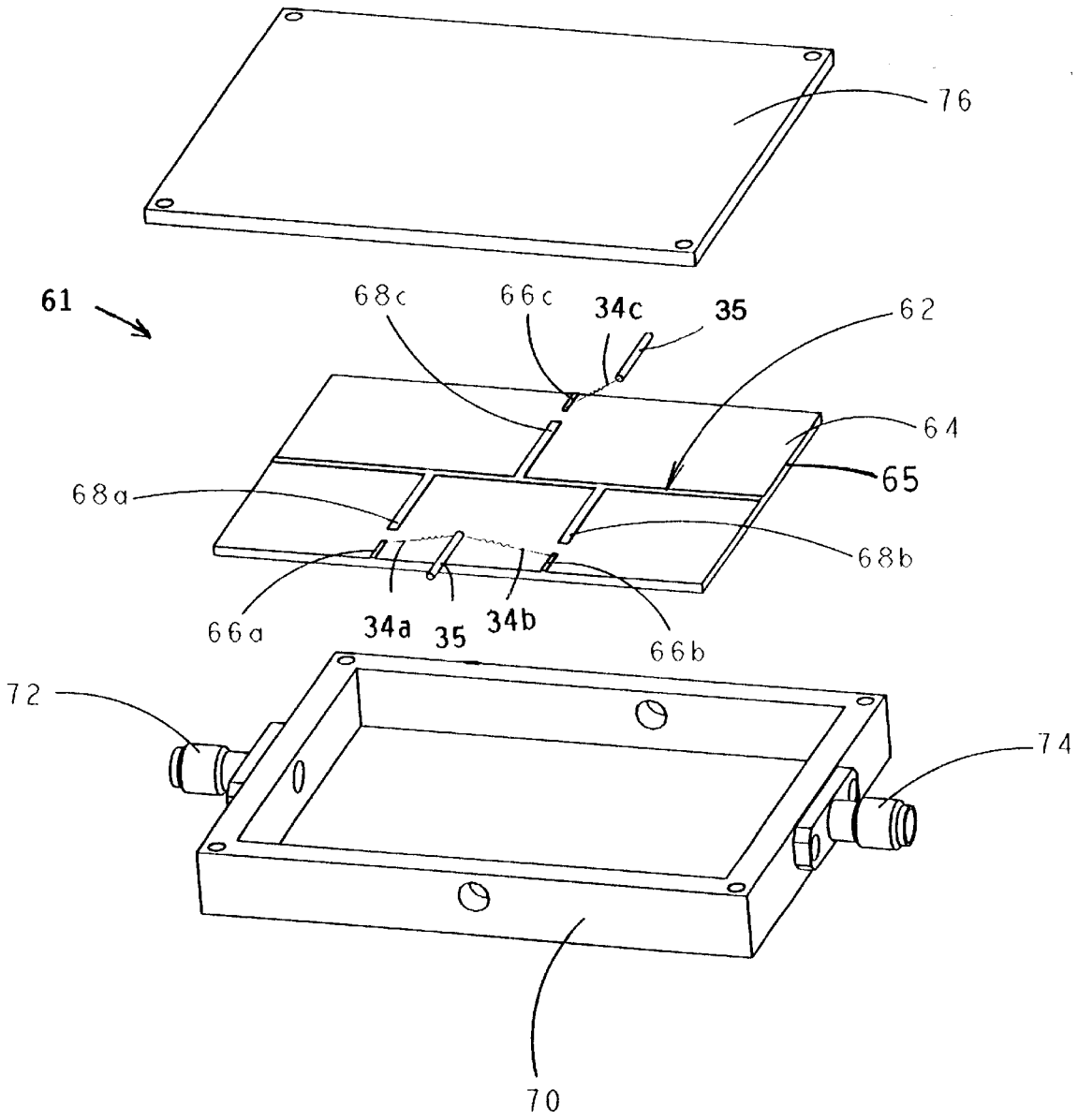
FIG. 9 is an exploded perspective view of a single layer HTS switch.
Figure 10A:
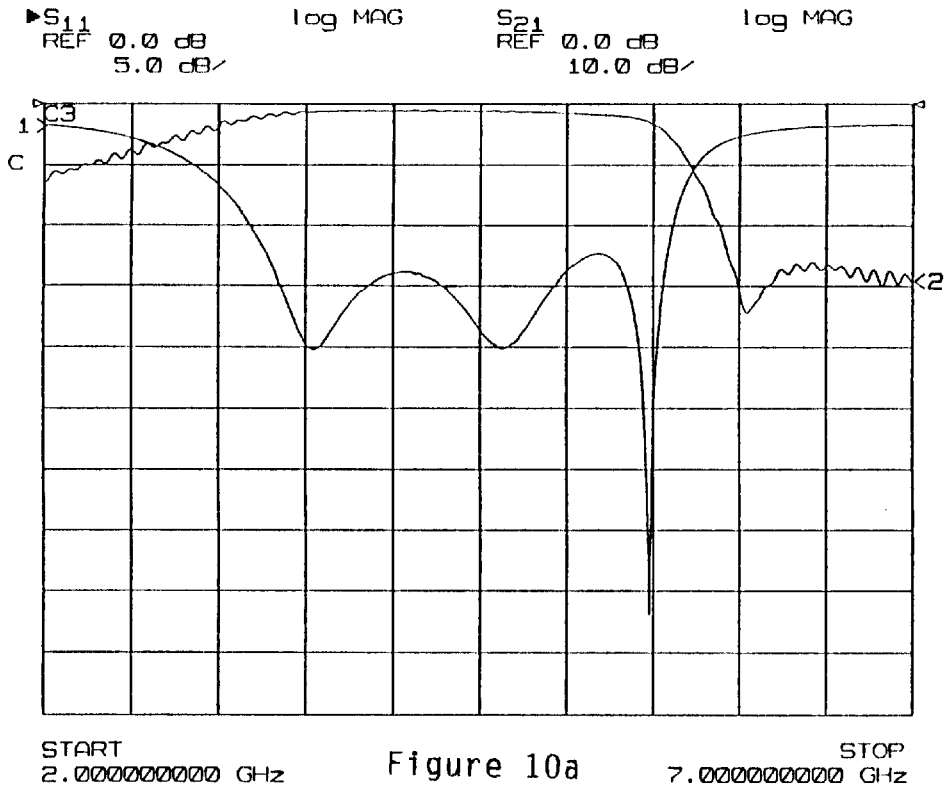
FIG. 10*a* is a graph of the measured RF performance of switch constructed in accordance with FIG. 9 in the on position.
Figure 10B:
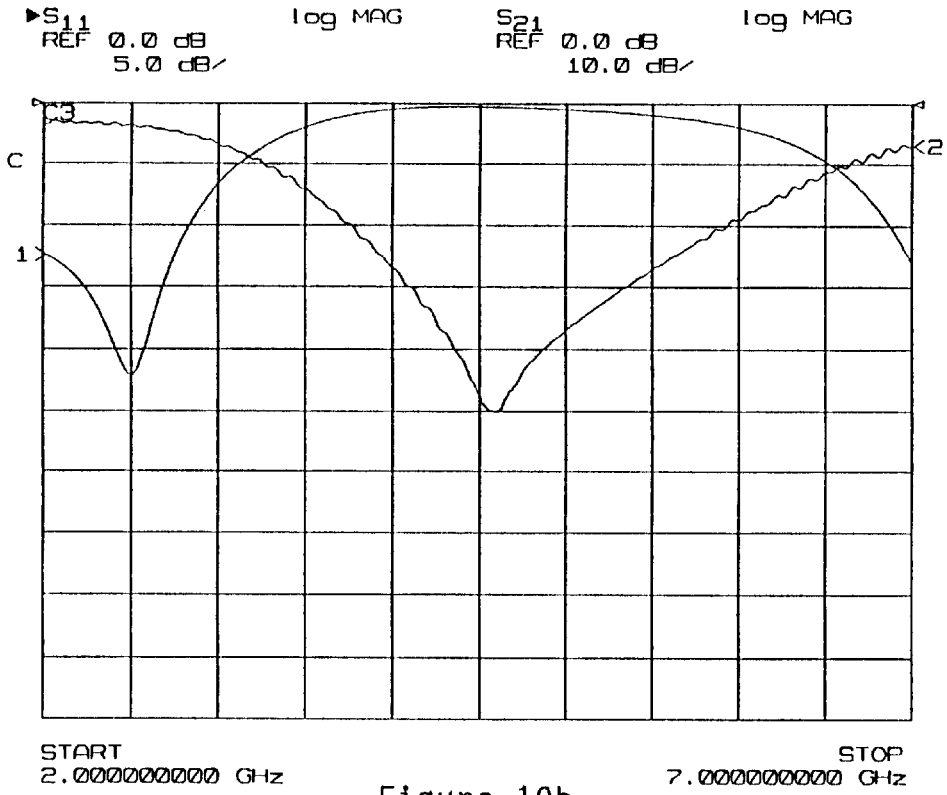
FIG. 10*b* is a graph of the measured RF performance of switch constructed in accordance with FIG. 9 in the off position.

In FIG. 9, there is shown a single layer switch 61 having a circuit 62 on a layer 64 of a substrate 65. The switch elements are narrow HTS lines 66*a*, 66*b* and 66*c* driven by DC current in the same manner as those shown in FIG. 4, but not shown in detail in FIG. 9. Capacitors 68*a*, 68*b* and 68*c* are located at the end of each of the three transmission lines 69*a*, 69*b* and 69*c*. Conductors 34*a*, 34*b* and 34*c* extend from conductors 35. The circuit 62 is mounted in a housing 70 having an input 72 and output 74 with a cover 76. Isolation between RF and DC is achieved by the capacitors 68*a*, 68*b* and 68*c*. The layer 64 is bonded into the housing 70 by epoxy (not shown). FIGS. 10*a* and 10*b* shown the measured results of the switch 61 of FIG. 9. It can be seen that FIG. 10*a* is a graph of the isolation and return loss when the switch is on and FIG. 10*b* is a graph of the isolation and return loss when the switch is off.

The present invention can be used to construct different types of switches including single pole double throw switches and with various switch matrices. While HTS switches are the preferred embodiment, the lower layer in a two layer switch can be made with a gold film on the substrate in place of the HTS film. Similarly, the transmission lines extending between an input and output can be made from HTS film, gold film or other suitable metallic film. The number of transmission lines and switch elements will vary with the bandwidth desired. While the present invention has been described as a switch and that is the preferred embodiment, the two layer embodiment can be used to interact with and control microwave circuits. Further, the present invention can be used to construct HTS microwave circuits using two layers to combine technologies that are incompatible with HTS into the HTS circuit. This is accomplished by dividing the circuit into two layers and constructing part of the circuit on the first layer and part of the circuit on the second layer.

Although the present invention has been fully described by way of example in connection with a preferred embodiment thereof, it should be noted that various changes and modifications will be apparent to those skilled in the art. Therefore unless otherwise such changes and modifications depart from the scope of the present invention, they should be construed as being included therein.

I claim:

1. An HTS microwave circuit comprising a first layer and a second layer, said first layer having a first HTS microwave circuit extending between an input and output thereof, said second layer having a second microwave circuit that is coupled to said first circuit, said second circuit having at least one element that is compatible with at least one of MEMS technology and flip-chip technology, but incompatible with HTS material, said at least one element being connected into said second circuit to interact with and control said first circuit, said second circuit not being directly connected into said first circuit.

2. A microwave circuit as claimed in claim 1 wherein said first layer is a substrate having a ground plane with said first circuit disposed thereon and said second layer is a substrate with said second circuit formed thereon.

3. A microwave circuit as claimed in claim 2 wherein said first circuit and said second circuit are respectively disposed on said first and second substrates as a corresponding said first circuit.

4. A microwave circuit as claimed in any one of claims 1, 2 or 3 wherein the second circuit includes means for isolating a DC signal from an RF signal of said microwave circuit.

5. A microwave circuit as claimed in any one of claims 1, 2 or 3 wherein said second circuit is coupled to said first circuit by one of capacitative coupling or inductive coupling.

6. A microwave circuit as claimed in claim 2 wherein said first circuit has two transmission lines and there are two elements of said at least one element of said second circuit.

7. A microwave circuit as claimed in claim 2 wherein said first circuit has three transmission lines and there are three elements of said at least one element, said three elements being selected from the group of MEMS technology, flip-chip technology and mechanical technology.

8. A microwave circuit as claimed in claim 7 wherein each element of said at least one element has two terminals, one terminal being connected to a part of said second microwave circuit that is coupled but not directly connected to said first circuit and another terminal being connected to a part of said second circuit that is short circuited.

9. A microwave circuit as claimed in claim 8, wherein said first and second circuits are located in a housing and said part of said second circuit that is short circuited is short circuited to said housing.

10. A microwave circuit as claimed in any one of claims 8, 9 or 6 wherein each element of said at least one element of said second circuit is a diode selected from the group of PIN, FET and GaAs.

11. A microwave circuit as claimed in any one of claims 8, 9 or 6 wherein said second circuit has a DC signal that is connected to control the passage of microwave energy through each element.

12. A microwave switch comprising a first layer and a second layer, said first layer having a first microwave circuit thereon that can carry an RF signal between an input and output thereof, said second layer having a second microwave circuit that is coupled to said first circuit, said second circuit having at least one switch element that can be controlled between an off position and an on position by a DC signal, with means for isolating said RF signal and said DC signal from one another, said second circuit not being directly connected into said first circuit.

13. A microwave switch as claimed in claim 12 wherein said first layer is a substrate having a ground plane and said second layer is a substrate, said first circuit and said second circuit being disposed on said respective substrates.

14. A microwave switch as claimed in claim 13 wherein said first and second circuit are disposed on said respective substrates as corresponding film circuits.

15. A microwave switch as claimed in claim 14 wherein said at least one element is selected from the group of a MEMS switch, flip-chip technology, mechanical switch technology and an HTS narrow strip that becomes non-superconductive when a high enough DC current flows through said narrow strip.

16. A microwave switch as claimed in any one of claims, 12, 13 or 15 wherein said first microwave circuit is an HTS circuit.

17. A microwave switch as claimed in any one of claims 12, 13 or 15 wherein said first circuit has two transmission lines and there is a respective switch element in said second circuit for each corresponding transmission line of said first circuit.

18. A microwave switch as claimed in claim 14 wherein said switch has a plurality of inputs and outputs including said input and output.

19. A microwave switch as claimed in claim 14 wherein said film circuits are selected from the group of microstrip and stripline and said second circuit is coupled to said first circuit by one of capacitative coupling and inductive coupling.

20. A microwave switch as claimed in claim 12 wherein said at least one element is a diode selected from the group of PIN, FET and GaAs. circuit.

21. A microwave switch as claimed in claim 12 wherein each switch element has two terminals, one terminal of said two terminals being connected to a part of said second circuit that is coupled but not directly connected to said first circuit and another terminal of said two terminals being connected to a part of said second circuit that is short circuited.

22. A microwave switch as claimed in claim 12 wherein each switch element has two terminals, one terminal of said two terminals being connected to a part of said second circuit that is coupled but not directly connected to said first circuit and another terminal of said two terminals being connected to a part of said second circuit that is short circuited.

23. A microwave switch comprising an HTS microwave circuit extending between an input and an output, said circuit having a transmission line containing a narrow length of high temperature superconductive material, said narrow length of high temperature superconductive material having one end connected to said ground and having an opposite end, said switch having a DC power source connected to said narrow length of high temperature superconductive material, said DC power source being connected to change said length of high temperature superconductive material between superconductive and non-superconductive states, with means to prevent current from said DC power source from flowing into said circuit past said opposite end of said narrow length of high temperature superconductive material, said DC power source not being connected into said HTS circuit.

24. A switch as claimed in claim 23 wherein said means for preventing current from said DC power source from flowing into said circuit beyond said opposite end of said narrow length of high temperature superconductive material is a capacitor located between said length of high temperature superconductive material and said HTS circuit past said length of high temperature superconductive material.

25. A switch as claimed in claim 23 wherein there is an additional transmission line. said additional transmission line having a narrow length of narrow high temperature superconductive material connecting that transmission line to ground.

26. A switch as claimed in claim 23 wherein there are two additional transmission lines, each additional transmission line having a length of narrow high temperature superconductive material connecting that transmission line to ground.

27. A switch as claimed in claim 26 wherein said input and output are a plurality of inputs and a plurality of outputs.

28. A switch as claimed in claim 23 wherein said second circuit is coupled to said first circuit by one of capacitive coupling and inductive coupling.

29. A method of combining a first HTS circuit with a second circuit having at least one of flip-chip technology, MEMS technology and mechanical technology, said second circuit not being directly connected into said first circuit, said method comprising constructing said first circuit on a first substrate having a ground plane, constructing said second circuit on a second substrate, arranging said first and second substrates to capacitatively or inductively couple said second circuit to said first circuit and controlling said first circuit through said second circuit.

* * * * *